US006581255B2

(12) United States Patent
Kay

(10) Patent No.: US 6,581,255 B2
(45) Date of Patent: Jun. 24, 2003

(54) LOCKING MECHANISM FOR CONVERTIBLE SHOE SYSTEM

(76) Inventor: Gail A. Kay, 539 W. Arlington Pl., Chicago, IL (US) 60614

( * ) Notice: Subject to any disclaimer, the term of this patent is extended or adjusted under 35 U.S.C. 154(b) by 0 days.

(21) Appl. No.: 09/848,906

(22) Filed: May 4, 2001

(65) Prior Publication Data

US 2002/0162202 A1 Nov. 7, 2002

(51) Int. Cl.[7] ..... A43B 3/12
(52) U.S. Cl. ..... 24/640; 24/662; 36/101
(58) Field of Search ..... 36/100, 101, 11.5; 24/662, 671, 664, 672, 665, 640

(56) References Cited

U.S. PATENT DOCUMENTS

| | | | | |
|---|---|---|---|---|
| 2,367,232 | A | * | 1/1945 | Marx |
| 2,368,314 | A | | 1/1945 | Marx |
| 2,491,297 | A | * | 12/1949 | Brown |
| 2,526,940 | A | | 10/1950 | Fello |
| 2,590,648 | A | | 3/1952 | Pitz |
| 2,761,224 | A | * | 9/1956 | Gardiner |
| 2,862,311 | A | | 12/1958 | Ellis |
| 2,912,773 | A | | 11/1959 | Boldt |
| 2,943,404 | A | | 7/1960 | Sultan |
| 3,139,661 | A | * | 7/1964 | Sixty, Sr. |
| 3,154,866 | A | * | 11/1964 | Laufbahn |
| 3,455,037 | A | | 7/1969 | Vlas et al. |
| 3,762,075 | A | * | 10/1973 | Munschy |
| 3,890,725 | A | | 6/1975 | Lea et al. |
| 3,925,915 | A | | 12/1975 | Colli |
| 3,983,642 | A | * | 10/1976 | Liao |
| 4,193,214 | A | * | 3/1980 | Wang |
| 4,297,798 | A | | 11/1981 | Colan |
| 4,314,412 | A | | 2/1982 | Anderson et al. |
| 4,333,247 | A | | 6/1982 | Marinelli |
| 4,348,820 | A | | 9/1982 | D'Alessio |
| 4,450,633 | A | | 5/1984 | Connelly |
| 4,461,102 | A | | 7/1984 | DeVicentis |
| 4,494,323 | A | | 1/1985 | Latraverse |
| 4,497,123 | A | | 2/1985 | Ehrlich |
| 4,535,554 | A | | 8/1985 | De Obaldia |
| 4,753,022 | A | | 6/1988 | Gasbarro |
| 4,839,948 | A | | 6/1989 | Boros |
| 4,869,000 | A | | 9/1989 | York, Jr. |
| 4,887,369 | A | * | 12/1989 | Bailey et al. |
| 4,998,329 | A | * | 3/1991 | Boros |
| 5,317,822 | A | * | 6/1994 | Johnson |
| 5,423,134 | A | | 6/1995 | Bagnaia et al. |
| 5,465,506 | A | * | 11/1995 | Matis et al. |
| 5,896,684 | A | * | 4/1999 | Lin |
| 6,349,486 | B1 | * | 2/2002 | Lin |

FOREIGN PATENT DOCUMENTS

| | | | |
|---|---|---|---|
| FR | 2787969 | * | 7/2000 |

* cited by examiner

*Primary Examiner*—James R. Brittain
(74) *Attorney, Agent, or Firm*—Brinks Hofer Gilson & Lione

(57) ABSTRACT

A novel locking mechanism for a convertible shoe system is disclosed comprising a shoe upper and a shoe sole. The locking mechanism comprises a female member and a male member wherein one of said male or female members is attached to the shoe upper and the other is housed in an opening formed in a sidewall of the shoe sole. The locking mechanism is configured so that the male member is securely received in the female member while the shoe is being worn under normal wear conditions. However, when it is desired to remove the shoe upper and substitute it for uppers of different styles or functionality, the shoe upper may be quickly removed from the shoe sole.

6 Claims, 15 Drawing Sheets

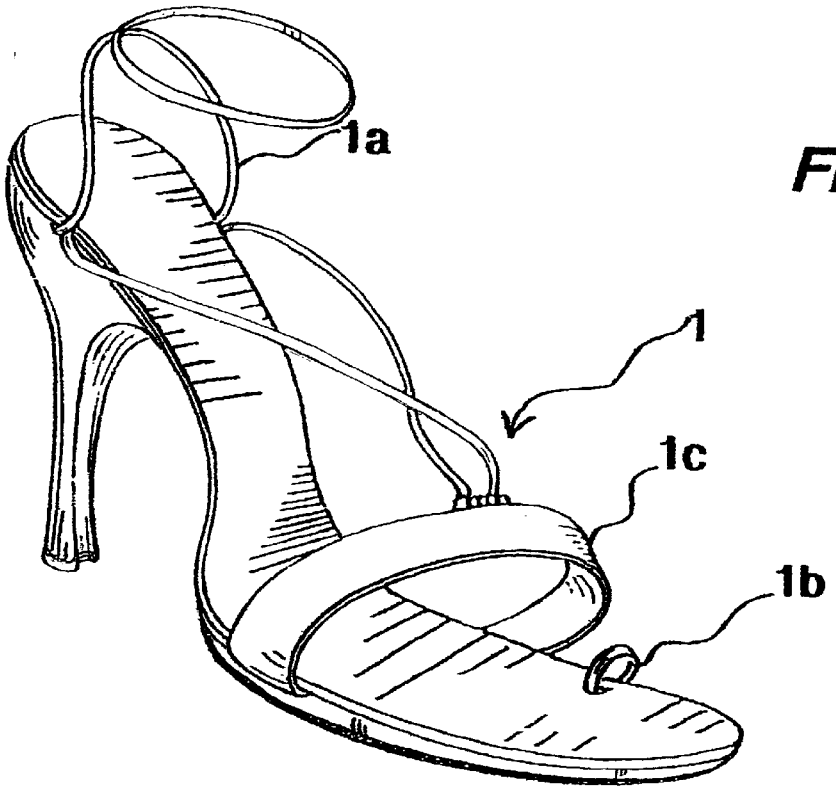
FIG. 1
FIG. 2
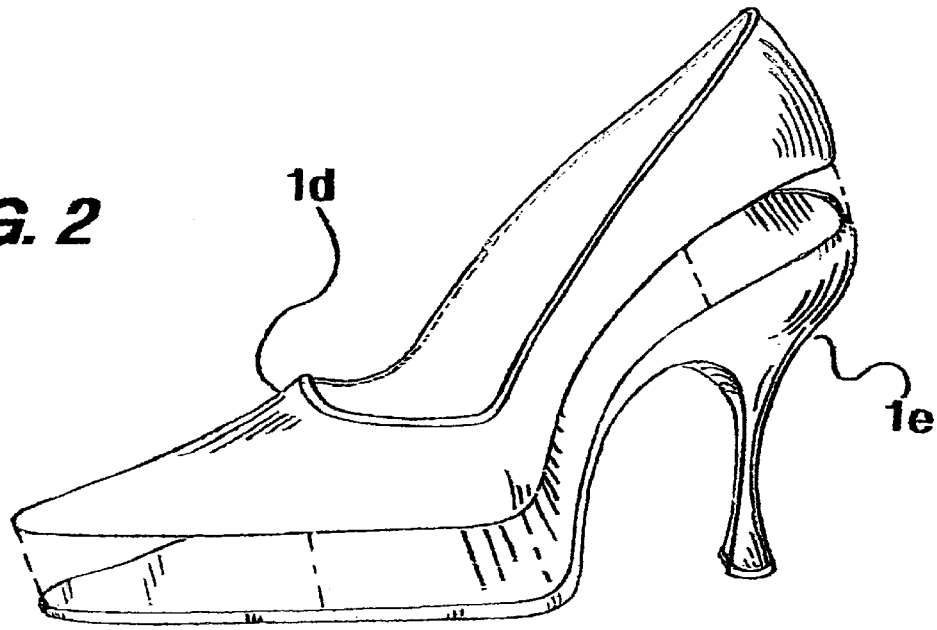

17
17
8
5
8
17
2
17
17
17
17
4
17
8a
29
8
8
8

FIG. 25
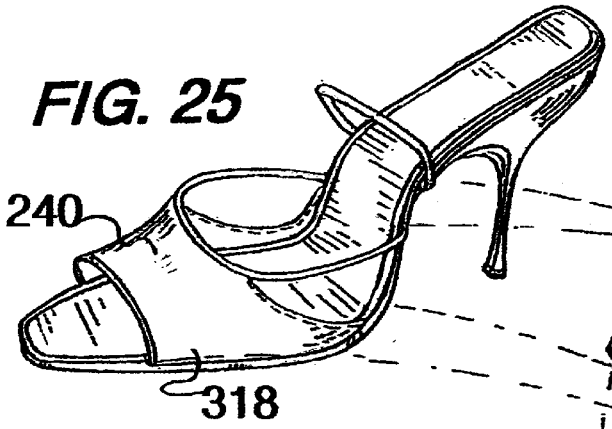
FIG. 26
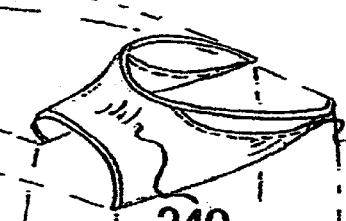
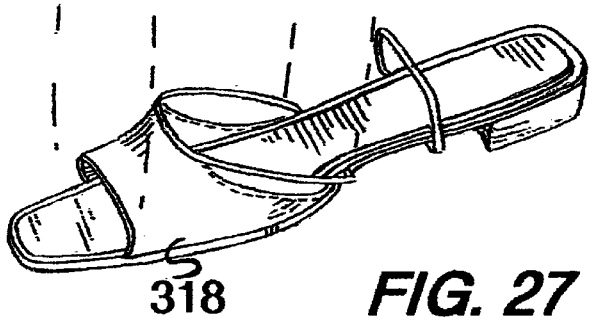
FIG. 27
FIG. 28
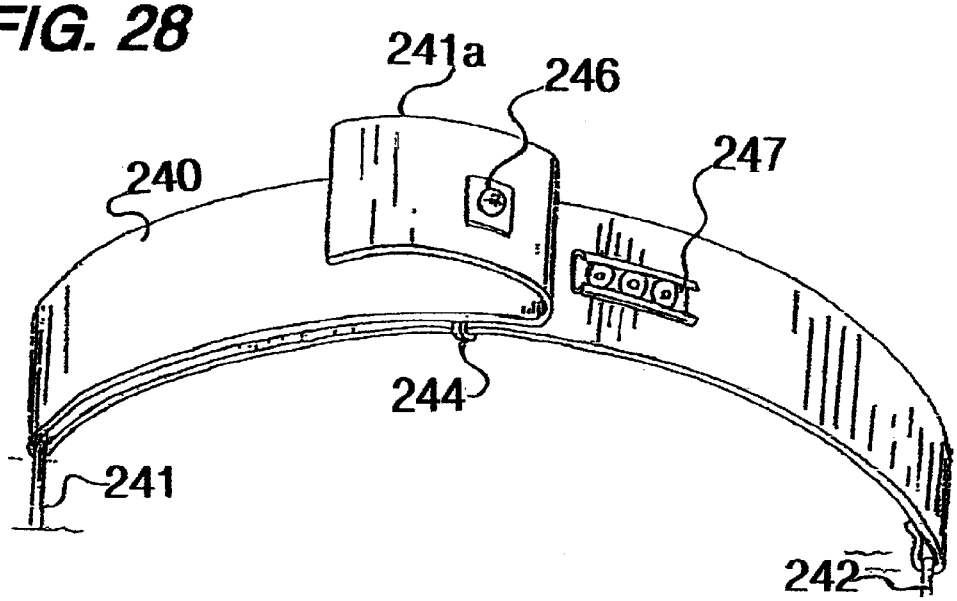

LOCKING MECHANISM FOR CONVERTIBLE SHOE SYSTEM

FIELD OF THE INVENTION

The present invention generally relates to a novel locking mechanism for a convertible shoe system. Convertible shoe systems comprise footwear having many fashion looks and a variety of utilities that are achieved by mixing and matching a variety of shoe uppers with a variety of shoe soles. The shoe uppers are removably locked to the shoe soles using the novel locking mechanism of the present invention.

BACKGROUND OF THE INVENTION

Convertible shoe systems are known wherein a variety of shoe uppers may be removably secured to a variety of shoe soles for achieving a multitude of functionalities and fashion looks. Such systems are disclosed in, for example, U.S. Pat. Nos. 4,839,948 and 4,461,102. These systems suffer from various shortcomings, however.

For example, U.S. Pat. No. 4,839,948 entitled "Convertible Footwear" discloses a variety of removable shoe uppers for a shoe sole. The mechanism disclosed for accomplishing this comprises a female member located in a side of the shoe sole and a male member attached to the shoe upper. The male and female members are engaged through the friction fit between a protrusion having a "curveaform" cross-section on one of said female or male members and a recess that is also "curveaform" in cross-section on the other of said female or male members (see FIGS. 5–5*c* and 6–6*c*). Alternatively, the female and male members may be made from magnetic or ferro-magnetic material so that the male and female members are engaged by magnetic attraction (see col. 6, lines 56–60). However, because the disclosed means for attaching the male and female members apparently are not sufficiently secure in their own right, pressure from the foot of the wearer upon the sole of the shoe is relied upon to prevent disengagement of the female and male members (see abstract). In particular, downward pressure from the foot is placed on the outer edges of the shoe insole as the means for maintaining the attached engagement of the male and female members. However, as explained below, reliance upon pressure from the wearer's foot for securing the female and male members is a shortcoming with the mechanism disclosed in the U.S. Pat. No. 4,839,948.

As the inventor of the present invention has recognized, substantial pressure from the foot of the wearer should not be relied upon for preventing disengagement of the male and female members of the shoe upper and the shoe sole. For example, when one's foot is picked up off the ground during walking there is very little if any downward pressure on sole of the shoe from the wearer's foot. This is also true when the wearer is running or encounters non-level terrain that results in pressure being applied along a vector other than a downwards direction. In addition, different people have varied walking styles where ideal downward pressure is only sporadically produced, if at all, by the wearer's foot. Accordingly, because of these various factors, the reliance upon substantial downward pressure from the wearer's foot is undesirable and the shoe upper is likely to unintentionally disengage from the shoe sole while being worn with the mechanisms disclosed in the prior art. Another shortcoming of the '948 patent is that no means are disclosed for securing the female member in the shoe sole. Accordingly, the female member could inadvertently become disengaged from the shoe sole while removing the shoe upper or during wear.

Finally, examining the manner for removing the male member from the female member in the mechanism disclosed in the '948 patent further reveals that unintentional disengagement is likely. The method of disengaging the male and female members disclosed in the '948 patent calls for first removing foot pressure from the insole and placing an outward pressure on the shoe upper. However, this is precisely the type of forces that will be experienced during the normal walking stride and, therefore, will likely lead to unintentional disengagement of the upper from the shoe sole.

With respect to U.S. Pat. No. 4,461,102, although the problem of unintentional disengagement is allegedly addressed, the aesthetics of the shoe are severely compromised. As can be understood from even a cursory review of the figures in that patent, the means for attaching the upper to the shoe sole are clearly visible thereby detracting from the aesthetics of the shoe and limiting the number of upper styles that can be used with the shoe.

Thus, it would represent an advancement in the art if a locking mechanism were provided for securely attaching a shoe upper to a shoe sole that is both secure without relying upon substantial pressure from the wearer's foot and capable of being placed in the shoe in a manner that does not detract from the aesthetics of the shoe. Preferably, the locking mechanism is substantially concealed when the shoe upper is attached to the shoe sole.

SUMMARY OF THE INVENTION

The applicant for the present invention has addressed the foregoing problems and has developed a novel locking mechanism for a convertible shoe system. The locking mechanism securely attaches a shoe upper to the shoe sole without requiring substantial downward pressure from the user's foot and is aesthetically pleasing in that the mechanism may be substantially concealed from view when the shoe upper is attached to the shoe sole. The shoe upper is preferably adjustable.

In one aspect of the present invention, a locking mechanism for a convertible shoe system comprising a shoe sole and a removable shoe upper is provided. The locking mechanism comprises a female member, wherein the female member has an opening and a locking clip positioned in the opening. The locking mechanism further comprises a male member that has an opening adapted to receive the locking clip of the female member. The locking clip engages the male member in a latch-type manner and prevents unintentional disengagement of the male member from the female member. One of the male and female members is attached to the shoe upper and the other of said male and female members is positioned in the shoe sole.

Preferably, the female member is positioned in a cavity formed in a sidewall of the shoe sole. The opening in the female member is preferably formed by a pair of spaced apart sidewalls, a base positioned between and integral with said sidewalls. The locking clip is integral with and projects upwardly from the base of the female member. In addition, a release member is housed in the opening of the female member. The release member functions to disengage the male and female members when pressure is applied to the release member. In particular, the release member comprises a top surface having an opening that is aligned with the opening of the male member when the male member is engaged with the female member. Thus, the locking clip of the female member projects through the opening in the release member and then through the opening in the male member. The release member further has a release surface and an underclip such that when pressure is applied to the release surface the underclip engages the locking clip thereby removing the locking clip from the opening in the male member and permitting disengagement of the male member from the female member.

BRIEF DESCRIPTION OF THE DRAWINGS

FIG. 1 is a perspective view of the convertible style shoe with several different uppers attached to the shoe sole.

FIG. 2 is a perspective view showing the placement of a fully enclosed pump style upper on the shoe sole.

FIGS. 25–27 show an adjustable upper that can be used on both a high-heeled and low-heeled shoe.

FIG. 28 is a perspective view of an adjustable shoe upper according to one aspect of the invention.

DETAILED DESCRIPTION OF THE PREFERRED EMBODIMENTS

The present invention is directed generally to a novel locking mechanism for use in a convertible shoe system. By convertible shoe system, it is meant a system by which a multitude of different shoe uppers may be removably attached to one or more shoe soles. Any type of shoe sole and shoe upper may be used in the present invention. Shoe soles may be thin or thick and made from a variety of materials such as leather, rubber or wood. Similarly, the shoe uppers may be made from a variety of materials and have a variety of styles. Examples of some of the shoe uppers that may be used in the present invention are shown in FIGS. 1–2. As illustrated in FIG. 1, the shoe upper 1 may comprise different strap types 1*a*, 1*b* and 1*c*. As shown in FIG. 2, the shoe upper 1*d* may comprise an upper that substantially encloses the wearer's foot. Additional shoe uppers are illustrated in FIGS. 3, 8–10, and 25–27, as well as elsewhere in this application. The present invention thus may be used with shoe uppers comprising straps, open heeled uppers, partially enclosed, fully enclosed or any other shoe upper or shoe upper combinations that one may desire. In addition, the shoe upper may be made from a variety of materials, including, by way of example, leather, vinyl, rubber, cloth or other materials. The present invention provides the advantage that multiple shoe uppers may be used with one or a minimum of shoe soles. Moreover, the shoe uppers may be quickly and easily interchanged for different fashion looks or desired functionalities. This is accomplished by using a novel locking mechanism for attaching the shoe uppers to the shoe sole that provides a secure attachment of the shoe upper to the shoe sole. In addition, the locking mechanism of the present invention is aesthetically pleasing from a fashion perspective in that the mechanism may be substantially concealed from view.

Figure 3:
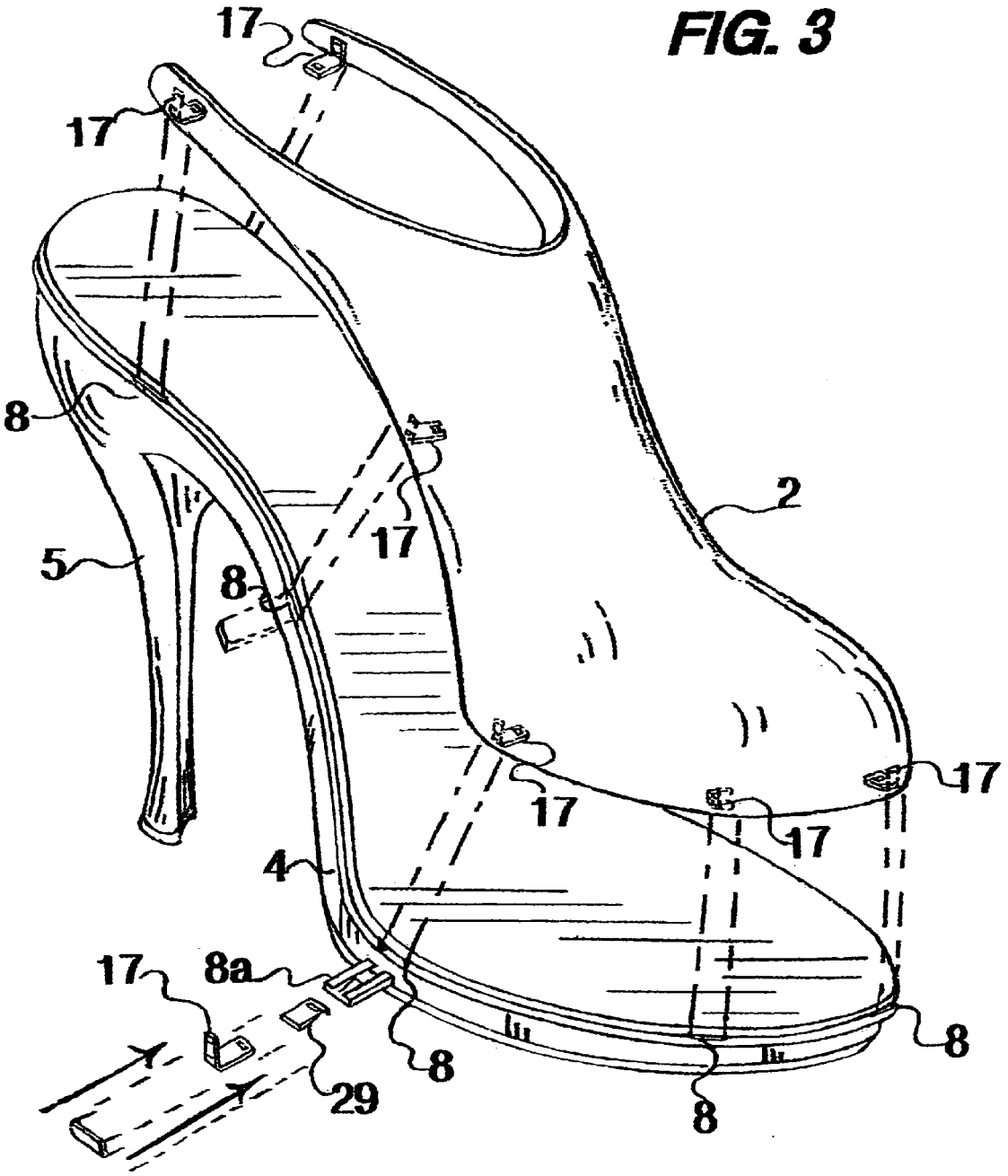
FIG. 3 is an exploded perspective view illustrating a partially enclosed upper, a locking mechanism and a shoe sole.

In one embodiment, the locking mechanism of the invention comprises a male member and a female member. One of said male or female members is attached to the shoe upper and the other is positioned in the shoe sole. As shown in FIG. 3, a male member 17 may be attached at one or more predetermined locations to the shoe upper 2 and a female member 8 may be positioned in one or more predetermined openings (not shown) in a sidewall 4 of the shoe sole 5. Preferably the female member 8 is positioned in the opening at a depth such that the leading edge 8*a* of the female member is flush with the sidewall 4 of the shoe sole such that the female member is substantially concealed from view. In addition, and as discussed in more detail herein, the female member preferably has a release mechanism 29 residing inside a cavity formed in the female member.

Figure 4:
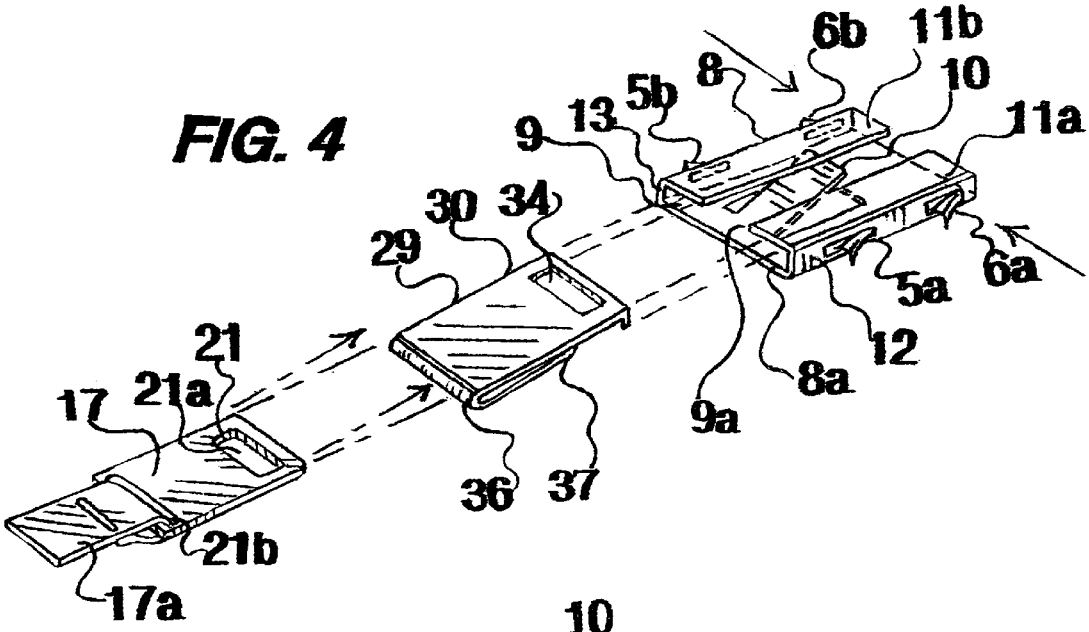
FIG. 4 is an enlarged perspective view of the locking mechanism illustrated in FIG. 3 for attaching the shoe upper to the shoe sole.
Figure 5:
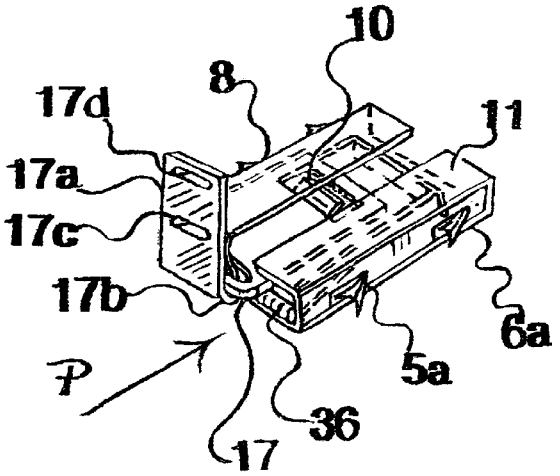
FIG. 5 is an enlarged perspective view of the locking mechanism illustrated in FIG. 4 in a state of engagement.

With reference to FIGS. 4–5, in one aspect of the invention, the locking mechanism comprises a female member 8, a male member 17 (a portion of a shoe upper 17*a* is also illustrated) and a release member 29. The female member has a base 9, sidewalls 12 and 13 and upper surfaces 11*a* and 11*b* separated by a narrow opening. Preferably, sidewalls 12 and 13 may be pressed inwardly as indicated by the arrows for placing the female member within an opening formed in a sidewall of the shoe sole. Once inserted, the sidewalls expand to assist in providing a snug fit of the female member in the shoe sole. A locking clip is formed by projection 10 integrally formed in the base 9. The locking clip projects upwardly at an angle from the base 9 and in a direction away from leading edge 8*a* of the female member. The locking clip is preferably made from a resilient or spring-like material such as, for example, steel or a polymer plastic. The female member further comprises an opening 9*a* for receiving male member 17 and a release member 29. The female member also has clenching fins 5*a*, 5*b*, 6*a* and 6*b* for securely anchoring the female member in the shoe sole as described herein. The clenching fins are resilient in a direction towards the sidewalls 12 and 13 of the female member. Thus, when the female member is inserted into an opening formed in the shoe sole, the clenching fins will flex slightly towards the sidewalls 12 and 13. Conversely, the fins resist movement in the opposite direction thus securing the female member in the opening of the shoe sole. In addition, the walls (not shown) forming the opening in the shoe sole may contain chambers for receiving the fins 5*a*, 5*b*, 6*a* and 6*b* providing for further secure attachment of the female member in the shoe sole.

The release member 29 is slideably positioned within female member 8. The release member has a planar upper surface 30 with an opening 34. The opening 34 is configured to receive the locking clip formed by projection 10 of the female member. When positioned within the female member, the locking clip may project through opening 34 as the release member slides within the female member. The release member further comprises an underlip formed by angled surface 37 adapted to engage the locking clip formed by projection 10 of the female member. Thus, when pressure is applied to release surface 36 of the release member 29 the member slides within the female member such that the underlip 37 of the release member engages and depresses the locking clip formed by projection 10 of the female member.

The locking mechanism further comprises a male member 17. The male member has an opening 21 configured to receive the locking clip 10 of the female member.

The locking mechanism of this embodiment thus works as follows. The release member 29 is slideably housed within female member 8 such that locking clip 10 projects through opening 34. The male member 17 is inserted into female member 8 between the upper surface 30 of the release member 29 and the underside of surface 11 of the female member until the opening 21 of the male member is aligned with opening 34 of the release member thereby receiving the locking clip 10 of the female member. Once the locking clip 10 is received in the opening 21 of the male member, the male and female members are securely attached by the abutting engagement of inside edge 21*a* of the opening in the male member and an underside of the locking clip in a latch-type relationship. Thus, the locking clip 10 should be configured so that it is not biased in a direction towards the male member. The male member 17 may be quickly and easily removed from the female member as follows. With reference to FIG. 5, pressure is applied to release surface 36 of the release member 29 as indicated by arrow P causing the release member to slide within the female member such that underlip 37 of the release member engages and depresses the locking clip 10 of the female member in a direction away from the male member. This causes the locking clip 10 to be removed from the opening 21 of the male member permitting the male member to be removed while maintaining pressure on the release surface 36 of the release member. Thus, in a preferred embodiment, separation of the male member from the female member is accomplished by the sequential performance of the following steps. First, pressure is applied to the release surface 36 and then an outward force is exerted on the male member 17 while maintaining inward pressure on the release surface 36. This release procedure is designed to prevent unintentional disengagement whereupon the steps must be performed in the aforesaid sequence. The release sequence is intended to avoid accidental disengagement of the male and female members.

Figure 6:
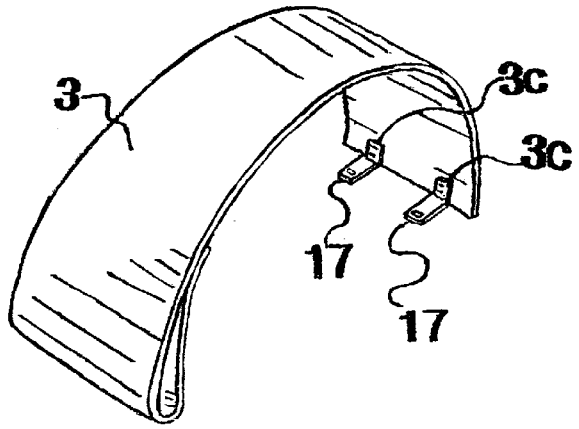
FIG. 6 is a perspective view of a shoe upper with two male members of the locking mechanism illustrated in FIG. 5 attached thereto.

As illustrated in FIGS. 4 and 6, the male member 17 may be secured to shoe uppers 17*a* and 3, respectively, by a variety of methods. Thus, as shown in FIG. 4, the upper 17*a* may be threaded through a second opening 21*b* in the male member 17 and secured back upon itself via stitching, adhesive or other appropriate means. In FIG. 6, the male member may be secured to upper 3 by rivets 3*c*. As those skilled in the art will readily appreciate, a multitude of methods may be used for attaching the male to the shoe upper.

Figure 7:
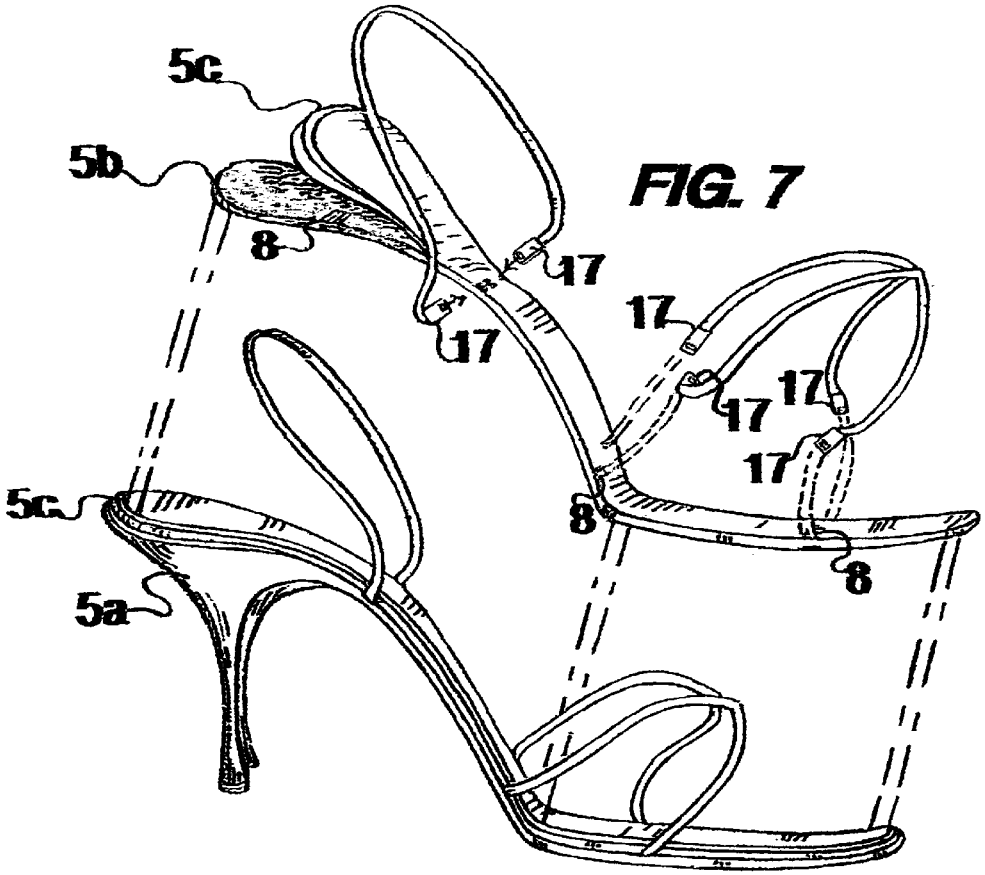
FIG. 7 is a perspective view illustrating the female member of the locking mechanism illustrated in FIG. 5 housed in a shoe insole having relative thickness.
Figure 8:
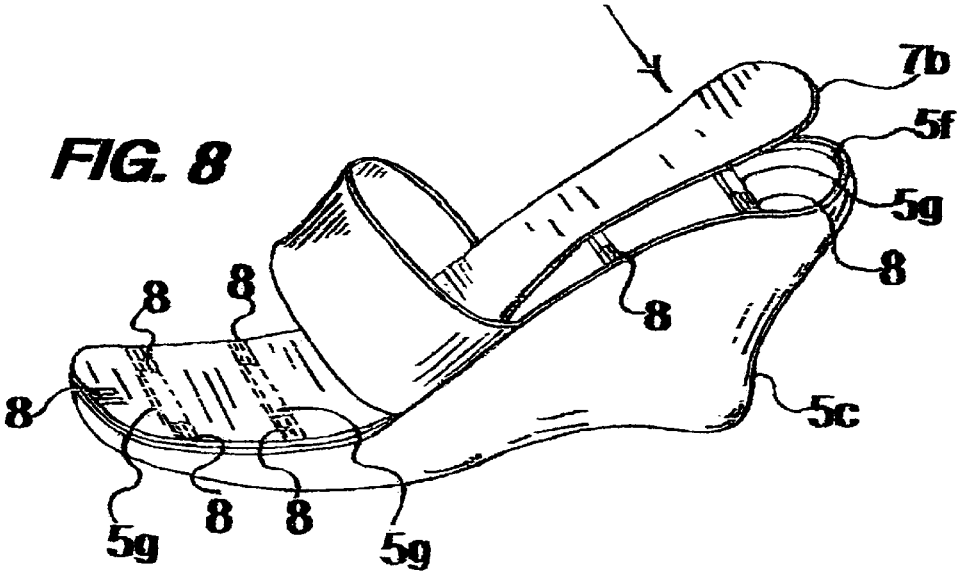
FIG. 8 is a perspective view illustrating the female member of the locking mechanism illustrated in FIG. 5 housed in a rubber sole shoe having a raised lip perimeter.

As shown in FIGS. 7 and 8, in one aspect of the invention, the female member 8 is positioned in an opening (not shown) formed in the shoe sole 5. The opening is sized such that the female member 8 snugly fits within the opening. The female member 8 may be retained in the opening by friction fit, cement or other adhesives, or by other suitable means such as the fins discussed above. The only requirement is that the female member be sufficiently secured inside of the opening of the shoe sole such that the female is not unintentionally removed from the shoe sole while the shoe is being worn or when the shoe upper is being removed. The shoe sole 5 may comprise sections including a shoe insole 5*b* that contacts the wearer's foot and lower portion 5*a* that contacts the ground. An outer wrap material or veneer 5*c* may be applied around the perimeter of the shoe insole 5*b*. This arrangement is particularly advantageous for thin, leathered soles or other thin soles where there is little room for housing the female member 8. Thus, as illustrated in FIG. 7, the female member 8 (and the release member 29) (not shown) are positioned in a narrow opening or slit formed in the shoe insole 5*b*. The insole 5*b* may be constructed from an injected molded or compression molded Polyurethane or synthetic foam textile. The female member 8 is installed by press fitting it into a pre-molded opening formed in the insole sidewall. An outer veneer 5*c* is then wrapped around the outer perimeter of insole 5*b* for the purpose of substantially concealing from view the female member 8 and the release member (not shown) and to assist in keeping the female and release members securely positioned in the opening formed in shoe insole 5*b*. It should be noted that numerous female members can be placed in the shoe insole and they will be substantially concealed from view even when not engaged with a male member. Small slits (not shown) are formed in the outer layer 5*c* so as to provide access for the male member (not shown) to the opening in the female member as previously described. The outer layer 5*c* may be made from any desired material, including leather, rubber, vinyl, or any other material for the desired fashion look or functionality. The insole 5*b* may be attached to the sole 5*a* through a variety of means, including cement or adhesive. The sole 5*a* may be made from leather, wood, rubber or other suitable material depending on the fashion look and functionality desired. In addition, when it is desired to disengage the male member from the female member, pressure may be applied to the release surface of the release member by applying pressure to that portion of outer layer 5*c* covering the release surface.

Alternatively, and as illustrated in FIG. 8, the female member 8 may reside in openings formed on the top surface of the shoe sole 5*e*, which may be made from a variety of suitable materials, including injection-molded rubber. Preferably, a raised lip 5*f* is formed around the perimeter of the top surface of the shoe sole 5*e*. The height of this lip is determined such that the top edge of the ridge ends just below the opening in the female member when the female member is placed in the openings on the top surface of the shoe sole 5*e*. Thus, with respect to the locking mechanism discussed with reference to FIGS. 4 and 5, the veneer overlies the outer edge 8*a* of the female member as well as the release surface 36 of the release member. This raised veneer 5*f* functions to retain the female member in the shoe sole while not blocking access to the female member by the male member. It further acts to substantially conceal the female member and the release member from view. A shoe insole 7*b* may be overlaid and attached to shoe sole 5*e* by any appropriate means including adhesive or cement to substantially conceal and secure the female member 8 in the shoe sole. The shoe insole 7*b* has narrow slits or openings (not shown) around a perimeter to provide access to the female member by the male member. Similarly, the male member may be disengaged from the female member by applying pressure to that portion of raised ridge 5*f* lying over the release surface of the release member.

Figure 9:
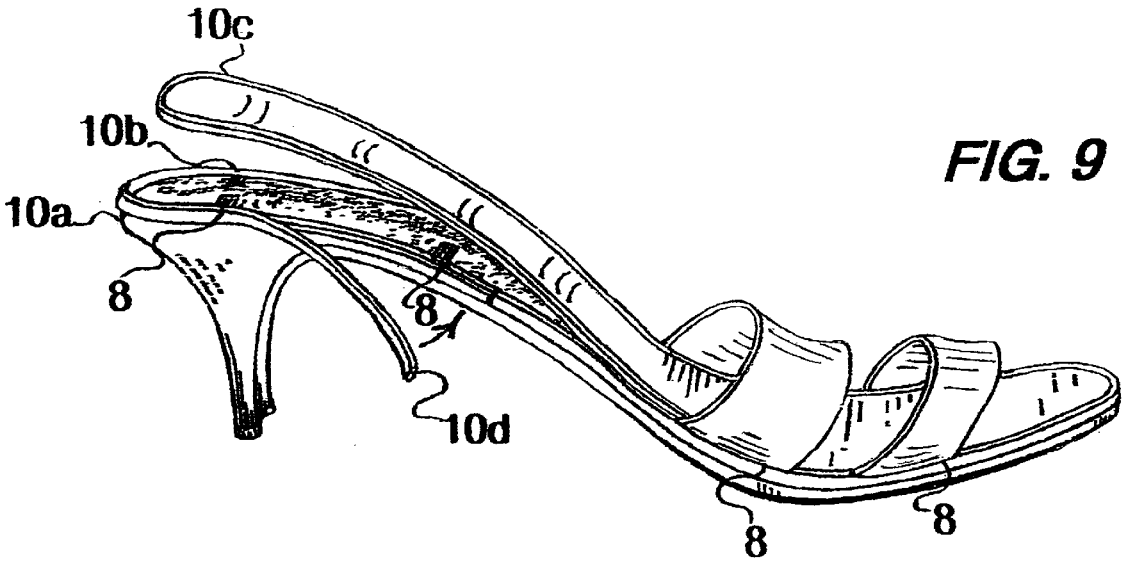
FIG. 9 is a perspective view illustrating the female member of the locking mechanism illustrated in FIG. 5 in a wood shoe sole having a beveled perimeter sole with a veneer.
Figure 10:
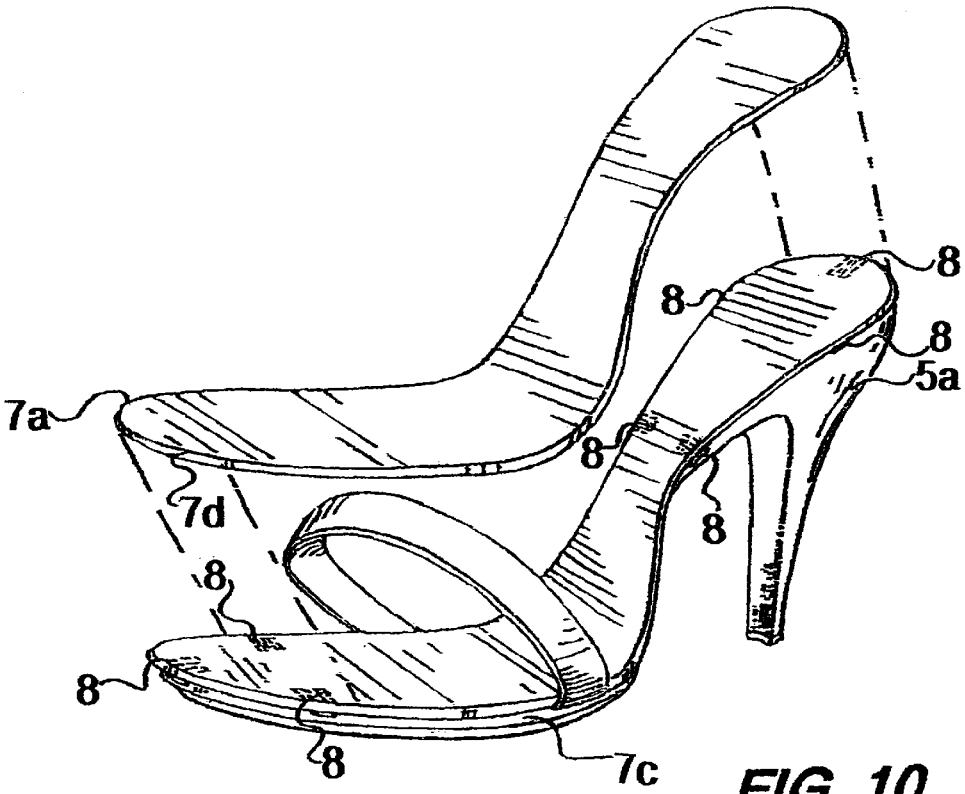
FIG. 10 is a perspective view illustrating the female member of the locking mechanism illustrated in FIG. 5 in a ridged sole.

FIGS. 9 and 10 disclose other methods of placing the female member 8 in the shoe sole. The embodiment illustrated in FIG. 9 is particularly adapted for use with a wood shoe sole. In this embodiment, openings are cut-out on the top surface of the shoe sole 10*b* at predetermined locations around the perimeter of the sole. These openings are sized to receive the female member 8. After the female members are inserted into the sole, an outer layer (or veneer) 10*d* may be attached to the perimeter of the sole 10*b* to conceal the female members (and the release members residing therein) but permitting access to the opening formed in the female member. Small slits (not shown) are formed in the outer layer 10*d* at predetermined locations to permit the male member to obtain access to the opening in the female member. Finally, a shoe insole 10*c* is layed over the sole 10*b* and within the outer veneer 10*d* and attached thereto through any suitable means. The embodiment disclosed in FIG. 9, although suitable for many shoe soles, is particularly advantageous for wood shoe soles. The openings for receiving the female member may be milled into the upper surface of the sole 10*b*.

In FIG. 10, the female member 8 may be placed in openings milled in shoe sole 7*c*. Shoe insole 7*a* with veneer 7*d* is placed over the shoe sole to substantially conceal the female member 8 (and release member) while permitting access to the opening of female member by the male member. This is preferably accomplished by slits (not shown) formed in the veneer 7*d* of the insole 7*a* positioned to align with the openings of female members 8.

Figure 11:
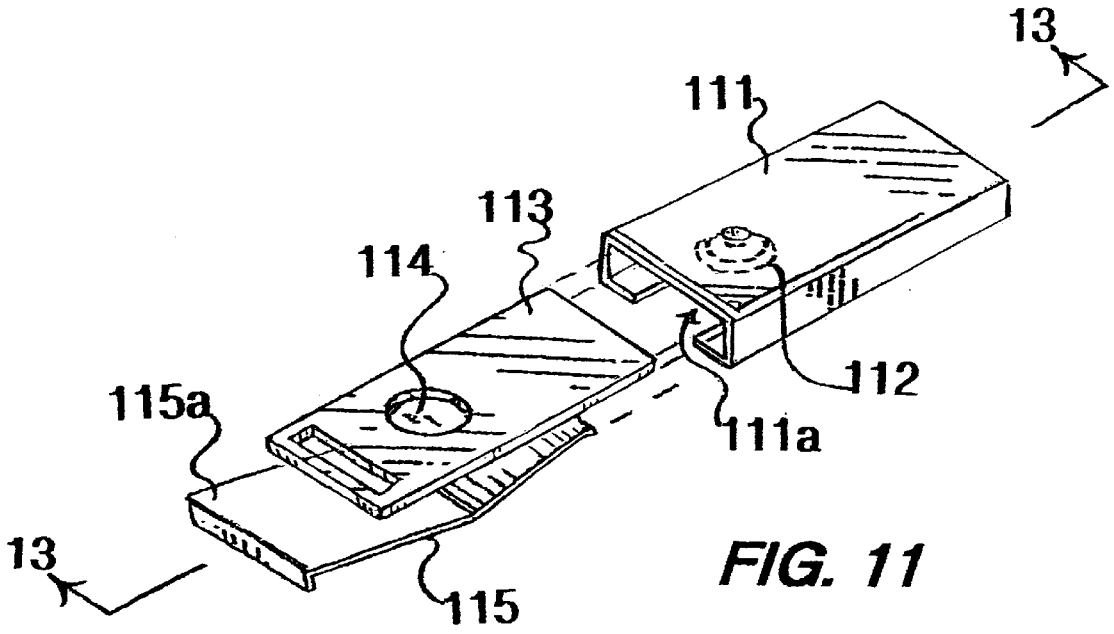
FIG. 11 is a perspective view of the mechanism according to another aspect of the invention prior to engagement.
Figure 12:
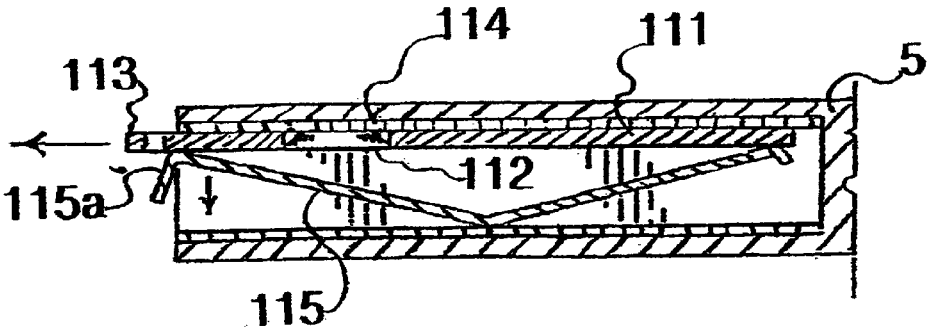
FIG. 12 is a cross-sectional view along line 12—12 of the mechanism illustrated in FIG. 11 in an engaged condition inside the shoe sole.

Another locking mechanism for attaching a shoe upper to a shoe sole is illustrated in FIGS. 11–12. A female member 111 resides in an opening formed in the shoe sole 5. The female member has an opening 111*a* and a locking clip formed by projection 112 (shown in phantom in FIG. 11), which is positioned within the opening 111*a*, and affixed to the upper surface of the female member. A male member 113 is provided with an opening 114 configured to receive the locking clip formed by projection 112 of the female member. A V-shaped release member 115 is provided which is housed within female member 111. In operation, male member 113 is inserted into the opening 111*a* formed in the female member while maintaining downward pressure on release surface 115*a* of the release member 115. After inserting the male member and releasing downward pressure on surface 115*a* of the release member, the release member will bias the male member upwards such that the opening 114 of the male member receives projection 112 thereby releasably securing the male member within the female member. To remove the male member, downward pressure is applied to release surface 115*a* of the release member thereby providing the clearance necessary to disengage projection 112 from the opening 114 in the male member 113. The male member may then be withdrawn from the female member while maintaining downward pressure on surface 115*a* on the release member. Also, clenching fins (see FIGS. 4 and 6) may be provided on side-walls of the female member for securely anchoring the female member in the shoe insole or sole.

Figure 13:
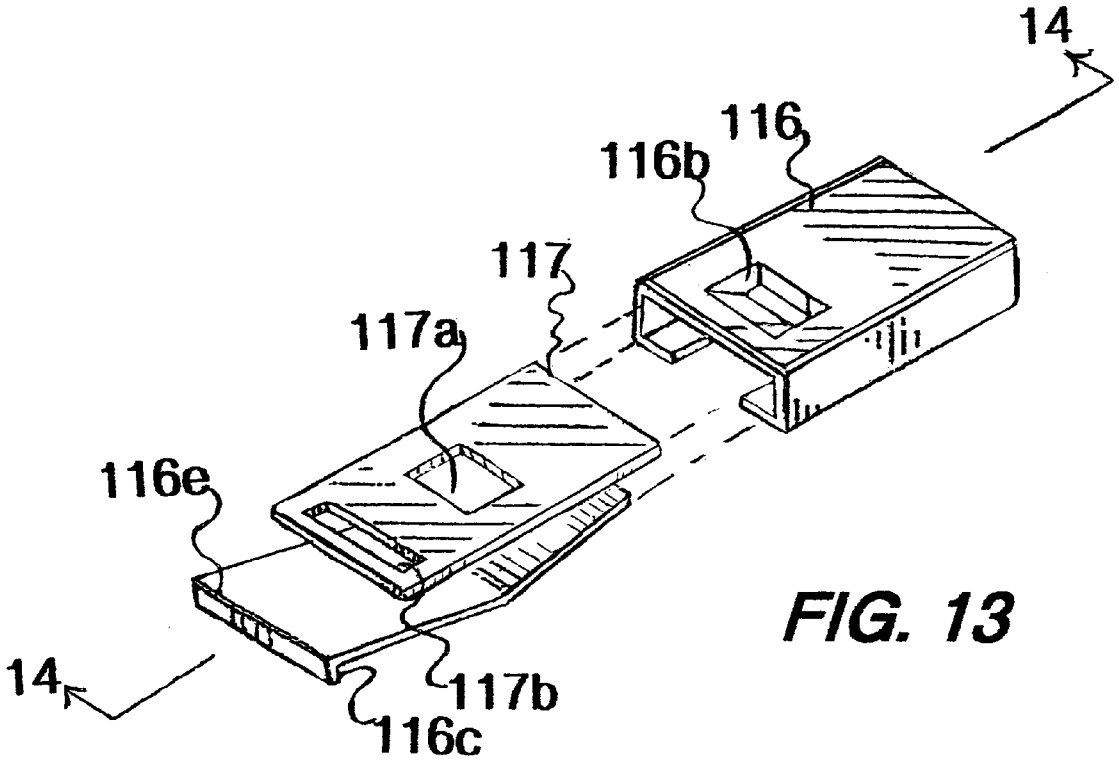
FIG. 13 is a perspective view of the mechanism according to another aspect of the invention prior to engagement.
Figure 14:
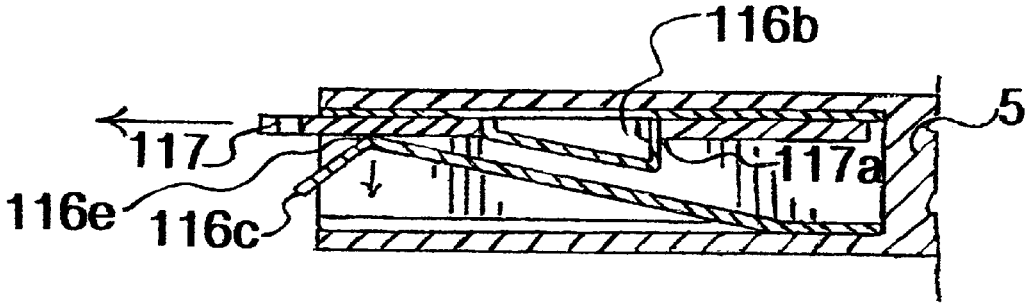
FIG. 14 is a cross-sectional view along line 14—14 of the mechanism illustrated in FIG. 13 in an engaged condition inside the shoe sole.

Another embodiment of the novel mechanism is illustrated in FIGS. 13 and 14 where the mechanism previously illustrated in FIGS. 12 and 13 is slightly modified. In this embodiment, there is a male member 117 and female member 116. The male member has an opening 117*a*. The female member 116 has a locking clip formed by rectangular-shaped projection 116*b* integrally formed therein. While maintaining downward pressure on release surface 116*e* of release member 116*c*, male member may be inserted into the female member such that the opening 117*a* is aligned with the locking clip 116*b*. At this point, the downward pressure on surface 116*e* of release member 116*c* is removed thus resulting in member 116*c* exerting upward pressure on the male member and biasing the male member such that the locking clip 116*b* engages and projects into the opening 117*a* of the male member thereby securing the male member within the female member. The male member may be removed by applying downward pressure on the release surface 116*e* of release member 116*c* such that the locking clip 116*b* disengages from the opening 117*a* allowing removal of the male member while maintaining downward pressure on surface 116*e* of the release member 116*c*. Also, clenching fins (see FIGS. 4 and 6) may be provided on sidewalls of the female member for securely anchoring the female member in the shoe insole or sole.

Figure 15:
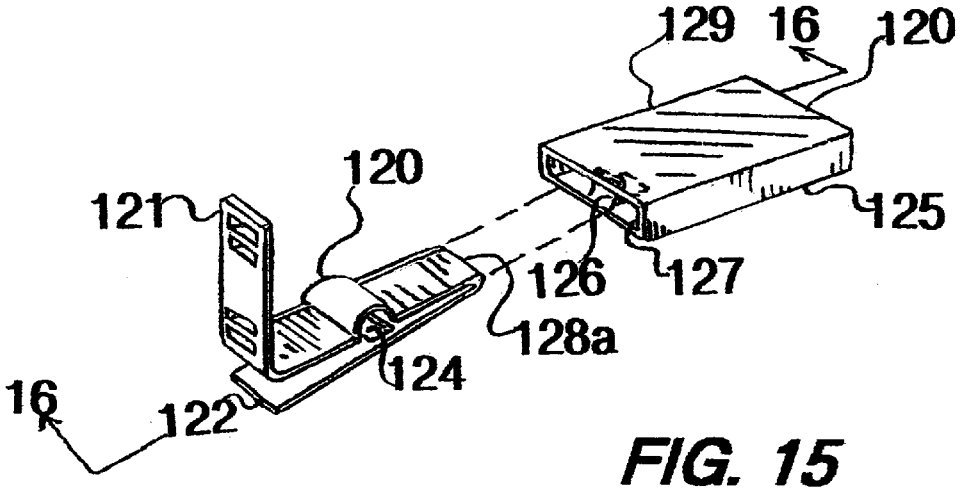
FIG. 15 is a perspective view of the mechanism according to another aspect of the invention prior to engagement.
Figure 16:
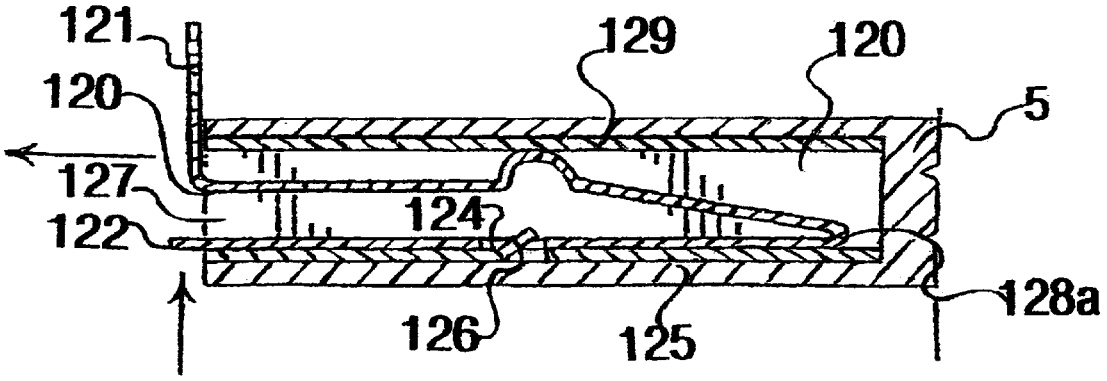
FIG. 16 is a cross-sectional view along line 16—16 of the mechanism illustrated in FIG. 15 in an engaged condition inside the shoe sole.

Another embodiment of the mechanism is shown in FIGS. 15 and 16. A male member 120 is provided. The male member has an arm 121 and base 122. Formed in base 122 is an opening 124 configured to receive a locking clip formed by arm 126 integrally formed on the base 125 of a female member 129. The locking clip 126 is resilient in a direction away from the male member. Thus, when the male member is inserted into the opening 127 of the female member, front edge 128*a* of the male member engages the locking clip 126 depressing it in a downwards direction until opening 124 of the male member is aligned with the locking clip. At this point, the downward pressure on the locking clip is released and the release member 126 biases in an upward direction and projects through the opening 124 of the male member thereby releasably securing the male member 120 within the female member 129. The male member may be removed by placing upward pressure on base 122 such that opening 124 clears locking clip 126 and withdrawing male member 120 while maintaining upward pressure on the base 122 of the male member. Also, clenching fins (see FIGS. 4 and 6) may be provided on side walls of the female member for securely anchoring the female member in the shoe insole or sole.

Figure 17:
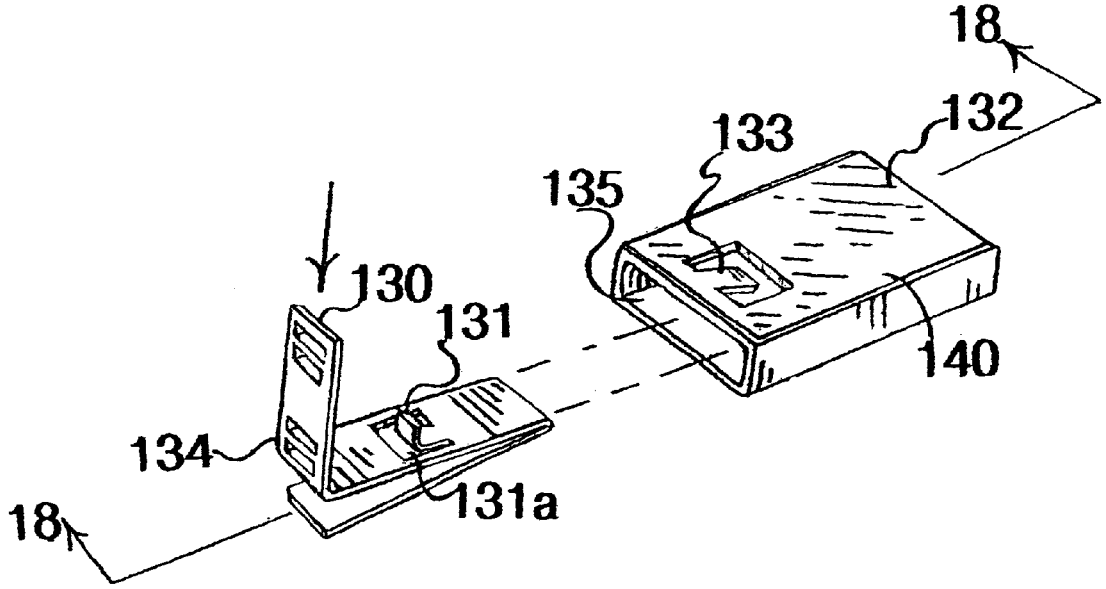
FIG. 17 is a perspective view of the mechanism according to another aspect of the invention prior to engagement.
Figure 18:
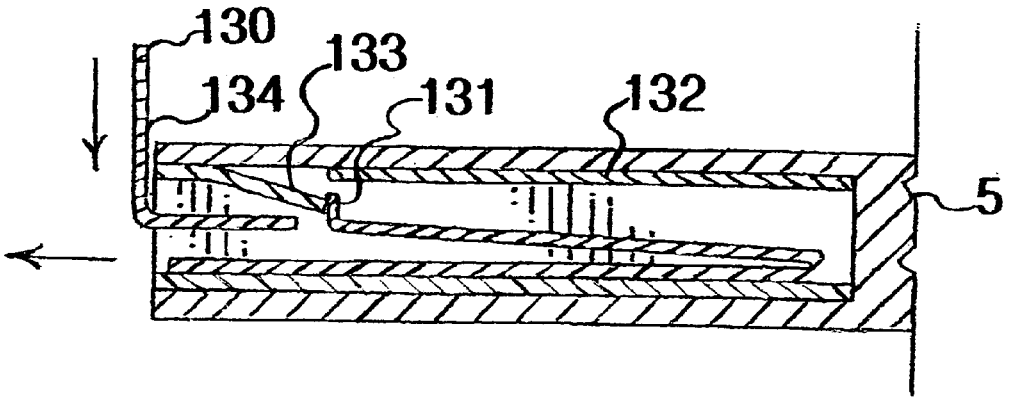
FIG. 18 is a cross-sectional view along line 18—18 of the mechanism illustrated in FIG. 17 in an engaged condition inside the shoe sole.
Figure 19:
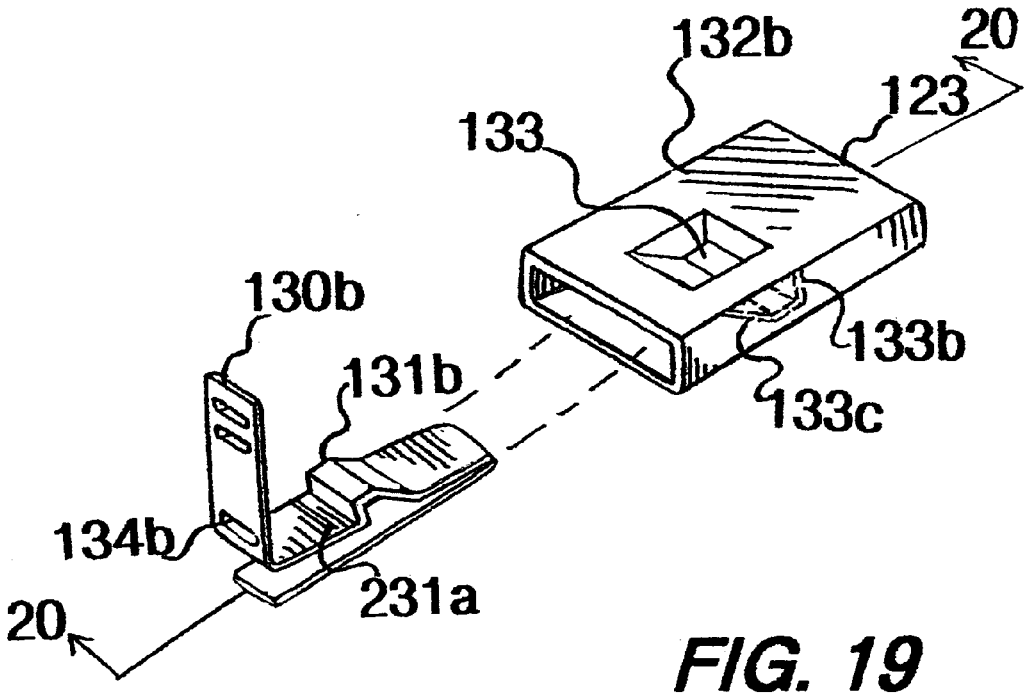
FIG. 19 is a perspective view of the mechanism according to another aspect of the invention prior to engagement.
Figure 20:
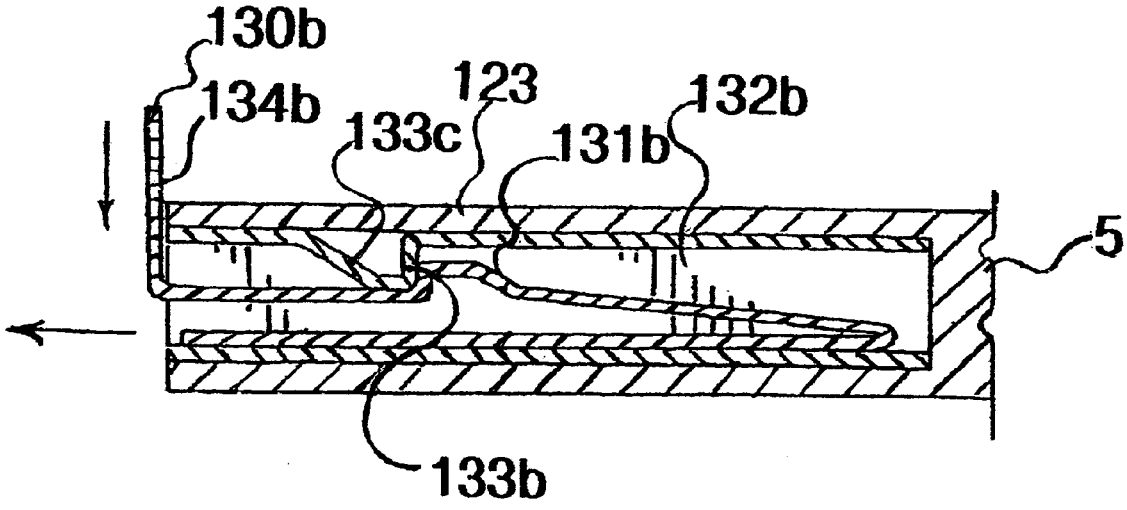
FIG. 20 is a cross-sectional view along line 20—20 of the mechanism illustrated in FIG. 19 in an engaged condition inside the shoe sole.

Another aspect of the invention is illustrated in FIGS. 17 and 18. In this embodiment an opening 131*a* in male member 130 is formed by arm 131 positioned on male member 130. Female member 132 has a locking clip formed by arm 133 formed on upper surface 140 of the female member and which extends into an opening 135 of the female member. The arm 131 is resilient in a direction towards the arm 134 of the male member. The locking clip 133 is resilient in an upward direction. Thus, when the male member 130 is inserted into the opening 135 formed in the female member 132, the arm 131 engages and while maintaining insertion pressure, passes under the female locking clip 133, which is biased upwards, for capturing locking clip 133 in the opening 131*a* and releasably securing the male member in the female member. The male member may be removed by exerting downward pressure as indicated by the arrow on arm 134 thereby providing sufficient clearance between the arm 131 and the female locking clip 133 to permit disengagement of the male member from the female member while maintaining downward pressure on the arm 134. Also, clenching fins (see FIGS. 4 and 6) may be provided on side walls of the female member for securely anchoring the female member in the shoe insole or sole. A similar embodiment is disclosed in FIGS. 19 and 20 where the parts corresponding to the above description have the suffix "b" added. In this embodiment, male opening is a depression 231*a* formed adjacent arm 131*b* and locking clip 133*b* is configured so that leading surface of arm 131*b* is adapted to slide along leading surface 133*c* of locking clip 133 when the male is inserted into the female member.

Figure 21:
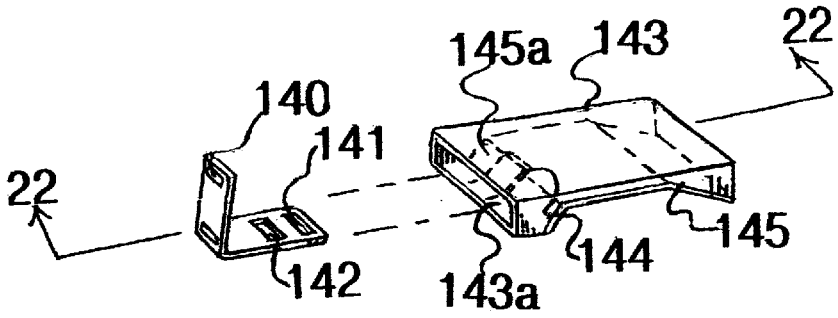
FIG. 21 is a perspective view of the mechanism according to another aspect of the invention prior to engagement.
Figure 22:
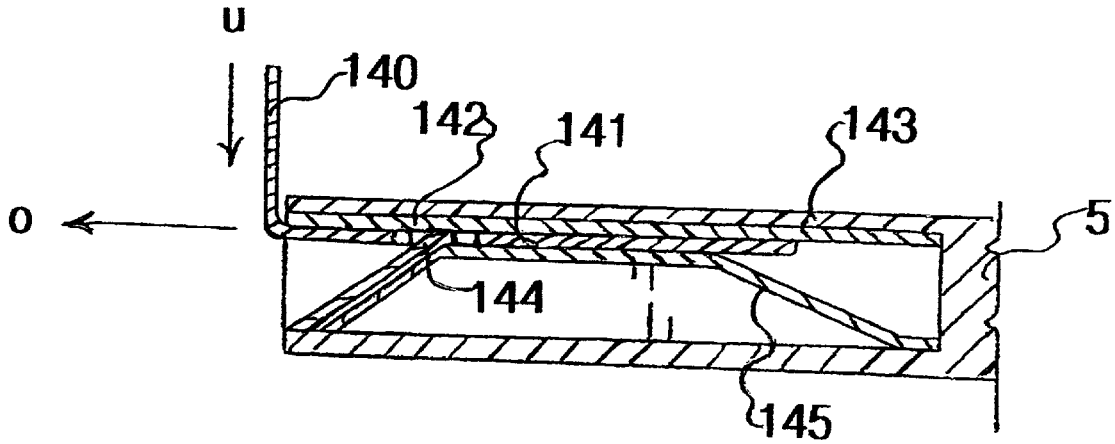
FIG. 22 is a cross-sectional view along line 22—22 of the mechanism illustrated in FIG. 21 in an engaged condition inside the shoe sole.

Yet another embodiment of the mechanism is disclosed in FIGS. 21 and 22. In this embodiment the male member has openings 141 and 142 configured to receive a locking clip 144 positioned within an opening 143*a* formed in a female member 143. The locking clip 144 is preferably integrally formed at the base 145 of the female member 143. The male member may be inserted into the female member such that the release member engages and projects through one of the two openings 141 and 142 thereby releasably securing the male member within the female member. The male member may be removed by applying an outward force in a direction away from the female member as indicated by the arrow O while applying a simultaneous upward force in the direction of arrow U. Also, clenching fins (see FIGS. 4 and 6) may be provided on side-walls of the female member for securely anchoring the female member in the shoe insole or sole.

Figure 23:
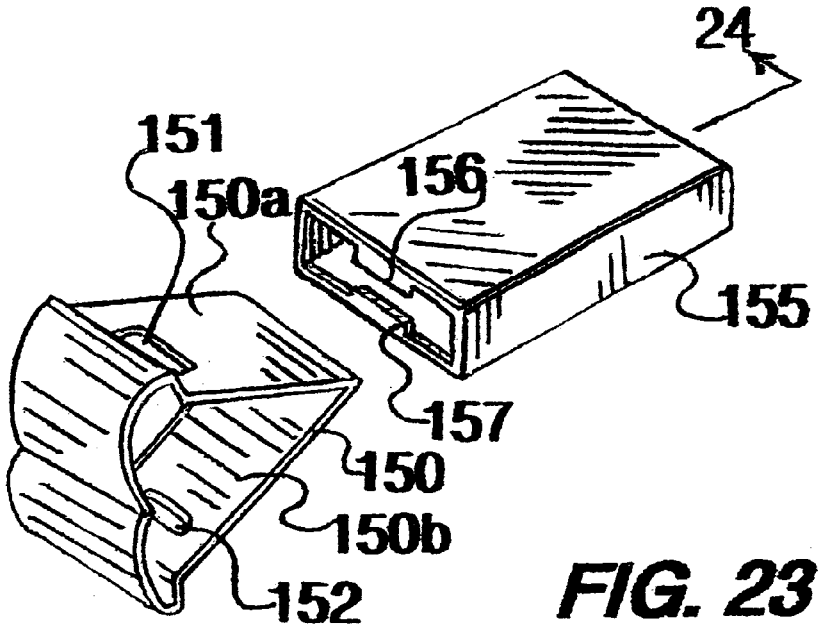
FIG. 23 is a perspective view of the mechanism according to another aspect of the invention prior to engagement.
Figure 24:
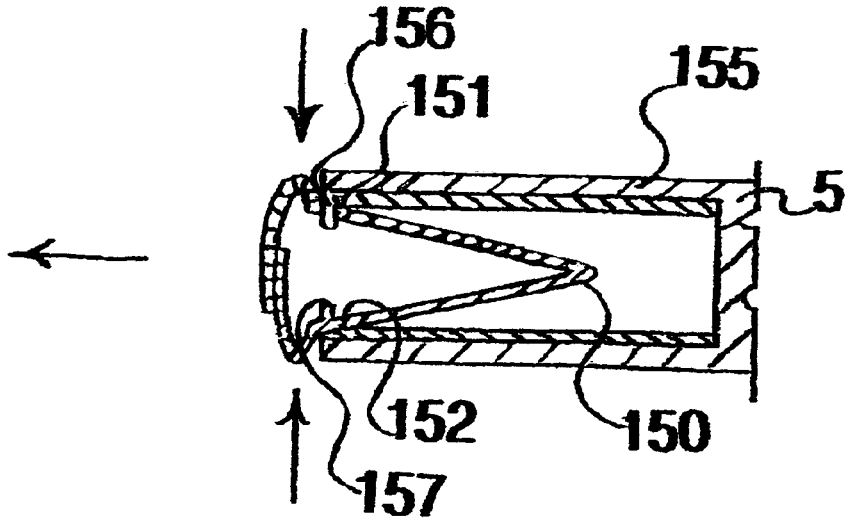
FIG. 24 is a cross-sectional view along line 24—24 of the mechanism illustrated in FIG. 23 in an engaged condition inside the shoe sole.

In another aspect of the invention, a locking mechanism as described in FIGS. 23 and 24 is provided. A male member 150 is provided having a generally v-shape. The male member has two openings 151 and 152, one positioned on each leg 150*a* and 150*b* of the v-shaped male member. Female member 155 has two locking clips formed by arms 156 and 157 configured to fit through the two openings 151 and 152 on the male member. The male member may be inserted into the female member such that the openings 151 and 152 on the male member receive the locking clips 156 and 157 of the female member thereby releasably securing the male inside the female member. The male member may be removed by squeezing on the two legs of the male member providing pressure as indicated by the arrows until sufficient clearance is created between the locking clips 156 and 157 and openings 151 and 152 to permit removal of the male member.

The foregoing male members, female members and release mechanisms may be made from numerous materials and are preferably made from steel.

The present invention also contemplates adjustable uppers which will provide for a custom fit and to permit the use of the same upper on different shoe types and shoe sizes. FIGS. 25 through 27 illustrate an adjustable upper 318 that can be used on a low-heeled shoe 319 or high-heeled shoe 320. Thus, with respect to FIGS. 25–27, the wearer's foot is at a different angle depending on the height of the heel on the shoe. Thus, in a high-heel shoe the wearer foot will be at a steeper angle than when a low-heeled shoe is worn. The adjustable upper can be adjusted to accommodate the angle of the wearer's foot depending on the heel height of the shoe. The adjustability of the upper also provides for "one size fits all" custom fit, reduces cost of the shoe system and simplifies the manufacturing process. The manner in which the shoe upper illustrated in FIGS. 25–27 may be adjusted is shown in greater detail in FIG. 28. In the embodiment illustrated in FIG. 28, a strap 240 is provided with male members 241 and 242 (only partially shown) as previously described at either end of the upper. The strap 240 is looped upon itself and maintained in this configuration by loop piece 244. In addition, attachment fixtures 246 and 247 are provided. Attachment fixture 247 has multiple attachment locations for varying the length of the upper 240. In this embodiment, attachment fixture has a male snap-like projection 246 and the attachment fixture has multiple female snap-on receptors 247. Other attachment fixtures could also be used, such as for example, magnets or adjustable slide buckles. Also, the male projections could reside on attachment fixture 247 and the female receptors could reside on fixture 246. Preferably, the attached fixtures 246 and 247 are placed on the strap such that when they are joined the attachment fixtures are substantially concealed from view.

Figures 29, 30:
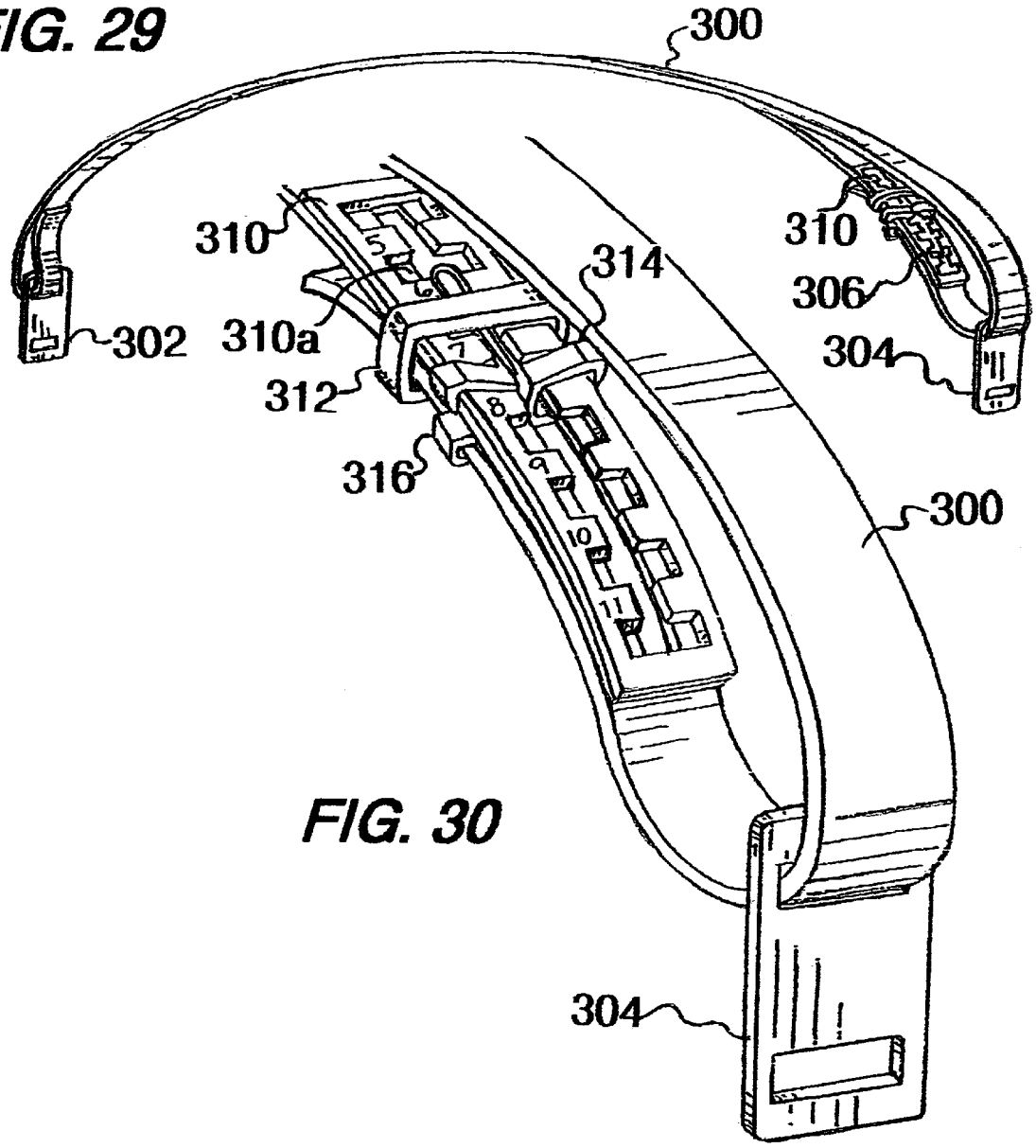
FIG. 29 is perspective view of an adjustable shoe upper according to another aspect of the invention.
FIG. 30 is an enlarged perspective view of the means for adjusting the shoe upper illustrated in FIG. 29.

FIGS. 29–30 illustrate another adjustable upper comprising an adjustable strap with indicia correlated to shoe size. In this embodiment, an upper 300 is provided with male members 302 and 304 as previously described. Attached to the upper is a length of lining 306 having an adjustable sizing bar 310 with a series of grooves 310*a*. Preferably there is a series of numbers corresponding to shoe size corresponding to each groove. Retaining clip 312 is configured to retain lining 306 adjacent to upper 300. A prong with arms 314 and 316 is also provided. Arms 314 and 316 are configured to be received in the grooves of the adjustable sizing bar 310. The length of the upper may be adjusted by moving the prong 316 along the adjustable sizing bar 310 and placing arms 314 and 316 in the grooves corresponding to the size of the wearer's foot.

Figure 31:
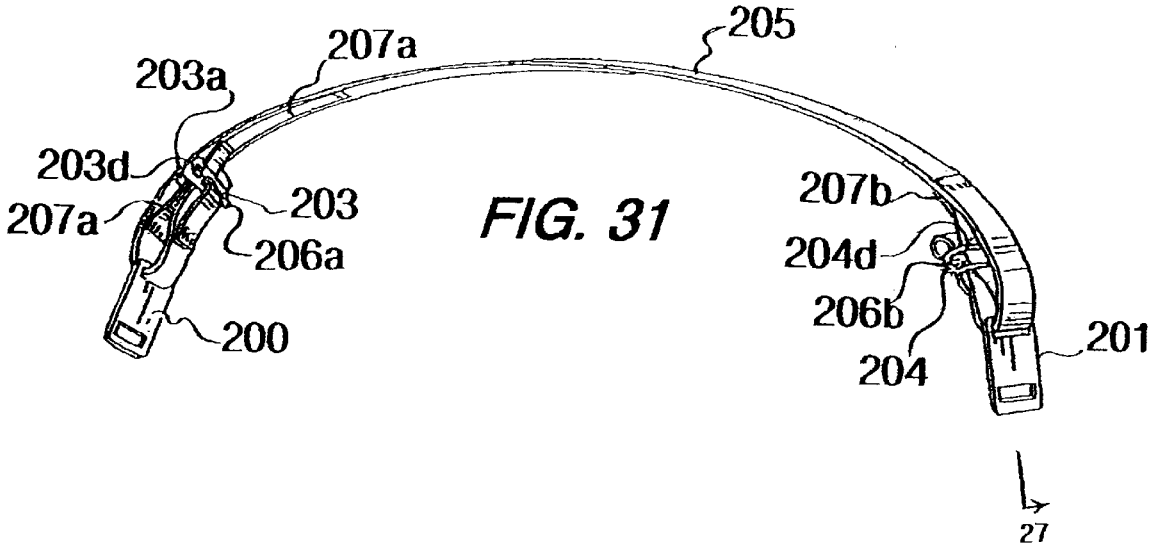
FIG. 31 is a perspective view of an adjustable shoe upper according to another aspect of the invention.

Another adjustable shoe upper is illustrated in FIG. 31. In this embodiment, a shoe upper 205 is provided with two male members 200 and 201 as previously described. Also included are spring clips 203 and 204. The spring clips 203 and 204 have arms 206*a* and 206*b*, respectively, secured to the upper 205 at opposite ends. A length of two pieces of lining 207*a* and 207*b* is attached at either end of the upper. Loops are thus formed at both ends of the upper 205 between linings 207*a* and 207*b* and upper 205 through which the base 203*d* and 204*d* of the spring clips 203 and 204 is threaded. Thus, the length of the strap 205 may be adjusted by moving spring clips 203 and 204 along the length of the upper linings 207*a* and 207*b*.

It will be understood by those skilled in the art that the foregoing embodiments describe the preferred embodiments of the invention and are not intended to be limiting. The scope of the invention is defined by the following claims and their equivalents.

I claim:

1. A locking mechanism for a convertible shoe system comprising a shoe sole and a removable shoe upper, the locking mechanism comprising:

a female member positioned in the shoe sole wherein the female member comprises an opening and a locking clip positioned in the opening, the opening being formed by a pair of spaced apart sidewalls, a base positioned between and integral with said side walls, wherein the locking clip is integrally formed with the base of the female member;

a male member attached to the shoe upper, the male member comprising an opening adapted to receive the locking clip; and a release member housed in the opening of the female member, the release member comprising a top surface, a release surface and an underlip, the top surface having an opening adapted to receive the locking clip of the female member and the underlip adapted to engage and remove the locking clip from the opening in the male member upon application of pressure to the release surface of the release member.

2. The locking mechanism of claim 1 wherein the shoe upper is adjustable.

3. The locking mechanism of claim 2 wherein the female member is substantially concealed from view.

4. The locking mechanism of claim 2 wherein the adjustable shoe upper comprises an attachment fixture.

5. The locking mechanism of claim 1 wherein the shoe upper comprises spring clips.

6. The locking mechanism of claim 2 wherein the adjustable shoe upper comprises indicia correlated to shoe size.

* * * * *